US005280318A

United States Patent [19]

Munson

[11] Patent Number: 5,280,318

[45] Date of Patent: Jan. 18, 1994

[54] APPARATUS FOR PROCESSING PHOTOSENSITIVE MATERIAL

[75] Inventor: Jan M. Munson, Ontario, N.Y.

[73] Assignee: Eastman Kodak Company, Rochester, N.Y.

[21] Appl. No.: 956,138

[22] Filed: Oct. 2, 1992

[51] Int. Cl.[5] ..... G03D 3/02

[52] U.S. Cl. ..... 354/324

[58] Field of Search ..... 354/297-; 134/64

[56] References Cited

U.S. PATENT DOCUMENTS

| | | | |
|---|---|---|---|
| 3,905,698 | 9/1975 | Schroter et al. | 355/27 |
| 3,990,088 | 11/1976 | Takita | 354/298 |
| 4,119,952 | 10/1978 | Takahashi et al. | 340/309.1 |
| 4,134,663 | 1/1979 | Laar et al. | 354/298 |
| 4,402,590 | 9/1983 | Rubin | 354/324 |
| 4,466,072 | 8/1984 | Kaufmann | 364/502 |
| 4,480,901 | 11/1984 | Osegowitsch et al. | 354/320 |
| 4,556,305 | 12/1985 | Osegowitsch | 354/298 |
| 4,577,950 | 3/1986 | Mackson | 354/324 |
| 4,989,028 | 1/1991 | Hall et al. | 354/324 |
| 4,994,840 | 2/1991 | Hall et al. | 354/324 |
| 5,025,279 | 6/1991 | Ellsworth | 354/298 |
| 5,108,878 | 4/1992 | Nakamura | 354/322 X |

*Primary Examiner*—D. Rutledge
*Attorney, Agent, or Firm*—Frank Pincelli

[57] ABSTRACT

A method for replenishing a solution in a film processor having a sump tank. The method provides for adding a sufficient amount of replenishment solution to the sump tank upon powering up of the film processor and in response to removing processing fluid from the sump tank and supplying it to the processor so as to raise the level of the processing fluid in the sump tank to a predetermined level. The addition of further replenishment solution is delayed until a predetermined amount of photosensitive material has been processed through the film processor. Thereafter replenishment solution is supplied to the sump tank in accordance with the amount of film that has been processed by the film processor.

4 Claims, 8 Drawing Sheets

A
B

FILL ON COUNTER > REPLEN. REQUIRED FOR FILM
115
Y
N
117
DECREMENT FILL ON COUNTER BY REPLEN. REQUIRED FOR FILM
121
SET FILL ON COUNTER TO 0
123
START REPLEN. PUMP ON TIMER BASED ON REPLEN. REQUIRED
119
SET REPLEN. REQUIRED FOR FILM TO 0
125
START REPLEN. REQUIRED TO 0
127
TURN ON REPLEN. PUMPS
HAS PUMP ON TIMER EXPIRED
129
N
Y
131
TURN OFF REPLEN. PUMPS

APPARATUS FOR PROCESSING PHOTOSENSITIVE MATERIAL

FIELD OF THE INVENTION

The present invention relates to an apparatus for processing photosensitive materials, such as sheets of x-ray film.

BACKGROUND OF THE INVENTION

The present invention is directed to a processing apparatus of the type which generally include upper and lower tanks for holding a processing fluid and a narrow processing chamber located between the tanks through which a sheet of photosensitive material is advanced for processing of latent images on the material. Processing fluid is delivered to opposite sides of the photosensitive material from each of the tanks for forming a processing fluid layer on each side of the photosensitive material. A return drain is provided on each side of the photosensitive material for removing and returning the processing fluid to the sump tank. Example of such devices are illustrated in U.S. Pat. No. 4,989,028; U.S. Pat. No. 4,994,840; and U.S. Pat. No. 5,059,997. Such devices are often referred to as fluid suspension processors.

In fluid suspension processors of the type illustrated in U.S. Pat. No. 5,059,997, processing fluid is pumped from a sump tank into the lower tank and is allowed to freely flow from the lower tank to the upper tank. During initial start up of the processor, a significant amount of processing fluid must be pumped into the tanks, thus significantly lowering the level of the processing fluid in the sump tank. This results in the processing fluid in the upper tank cascading a large distance when returning to the sump tank which in turn results in bubbles forming due to the high agitation in the processing fluid. This high agitation can significantly reduce the available chemistry in the processing fluid and thereby increase the total amount of chemistry used by the processor per unit of film. Additionally the lowering of the processing fluid in the sump tank results in a large quantity of fresh replenishment solution be supplied to the sump tank. This provides a large quantity of new chemistry for processing of photosensitive material. However, the processor still continue to add additional replenishment solution in accordance with the amount of photosensitive material that is processed. This results in significant reduction in the efficient use of the available chemistry in the processing fluid.

The present invention is directed to solving the problems of the prior art by providing means for minimizing the distance the processing fluid must travel to the sump tank and for the efficient utilization of the new chemistry added to processing fluid.

SUMMARY OF THE INVENTION

In accordance with one aspect of the present invention there is provided a method for replenishing a solution in a film processor having a sump tank for holding a processing fluid, a processing chamber for processing of a photosensitive material, and means for removing processing fluid from the sump tank and delivering it to the processing chamber for processing of a photosensitive material. The method comprises the steps of:

adding a sufficient amount of replenishment solution to the sump tank upon powering up of the film processor and in response to supplying processing fluid to the processing chamber from the sump tank so as to raise the level of the processing fluid in the sump tank to a predetermined level;

delaying the addition of further replenishment solution until a predetermined amount of photosensitive material has been processed through the film processor; and thereafter replenishing the processing fluid in the sump tank in accordance with the amount of film that has been processed by the film processor.

In accordance with another aspect of the present invention there is provided a method for replenishing a solution in a film processor having a sump tank for holding a processing fluid, a processing chamber for processing of a photosensitive material, and means for removing processing fluid from the sump tank and delivering it to the processing chamber for processing of a photosensitive material. The method comprising the steps of:

monitoring the level of the processing fluid within the sump tank and adding a sufficient amount of replenishment solution to the sump tank so as to raise the level of the processing fluid in the sump tank to a predetermined level;

delaying the addition of further replenishment solution until a predetermined amount of photosensitive material has been processed through the film processor; and thereafter replenishing the processing fluid in the sump tank in accordance with the amount of film that has been processed by the film processor.

BRIEF DESCRIPTION OF THE DRAWINGS

In the Detailed Description of the Preferred Embodiment of the invention presented below, reference is made to the accompanied drawing, in which.

DETAILED DESCRIPTION OF THE PREFERRED EMBODIMENT

Figure 1:
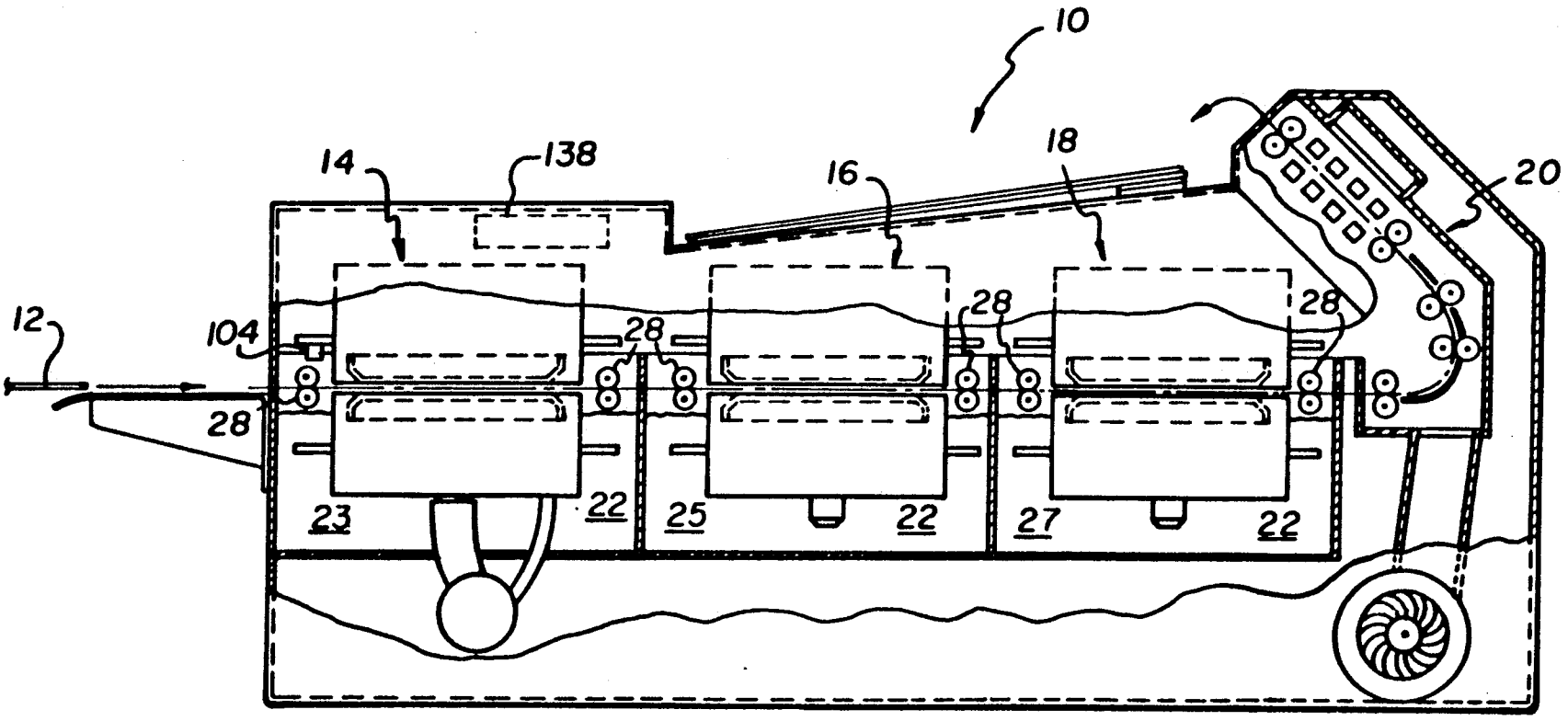
FIG. 1 is a cross-sectional view of a photographic processing apparatus made in accordance with the present invention.
Figure 2:
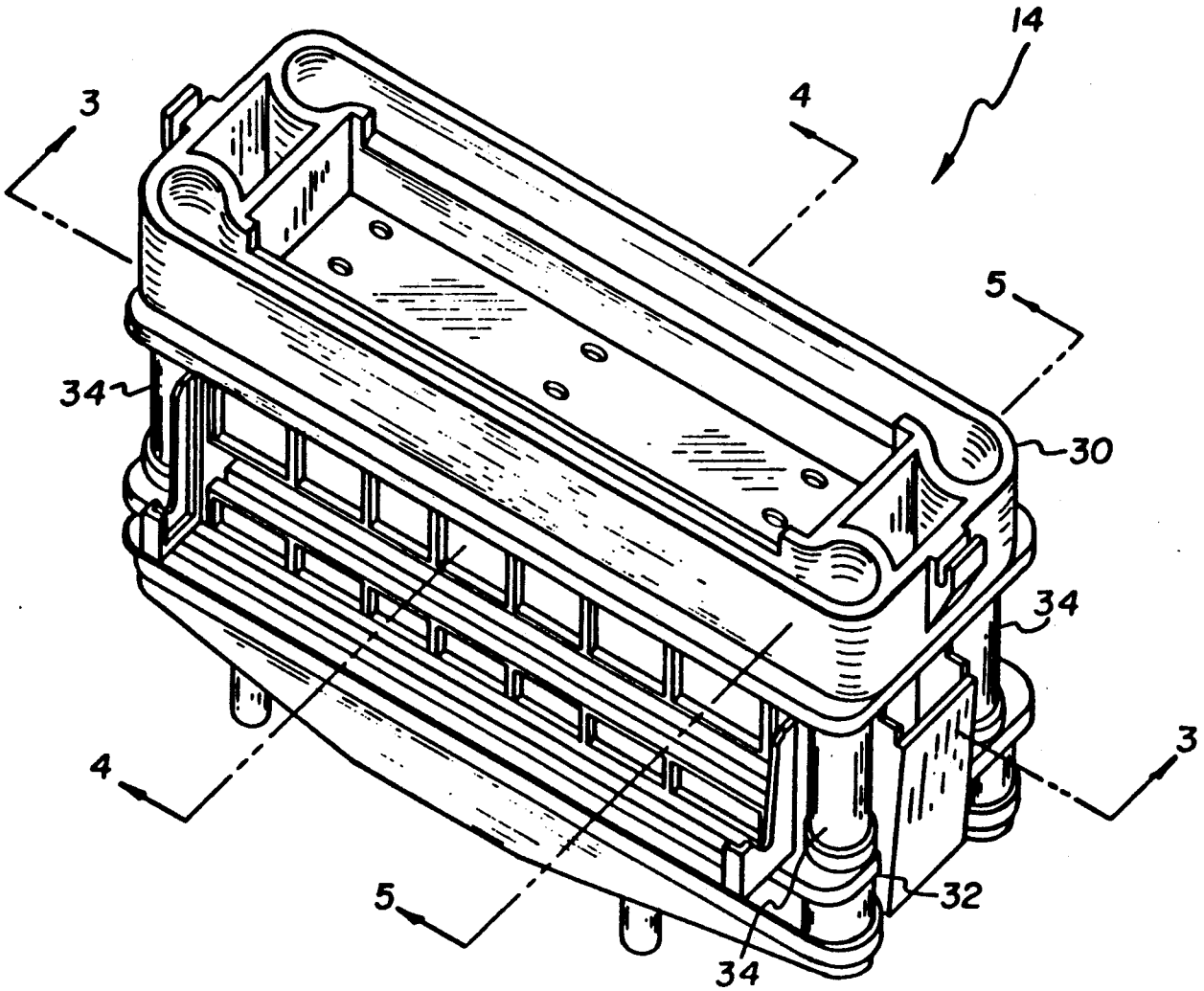
FIG. 2 is perspective view of one of the processing units of the processing apparatus of FIG. 1.
Figure 3:
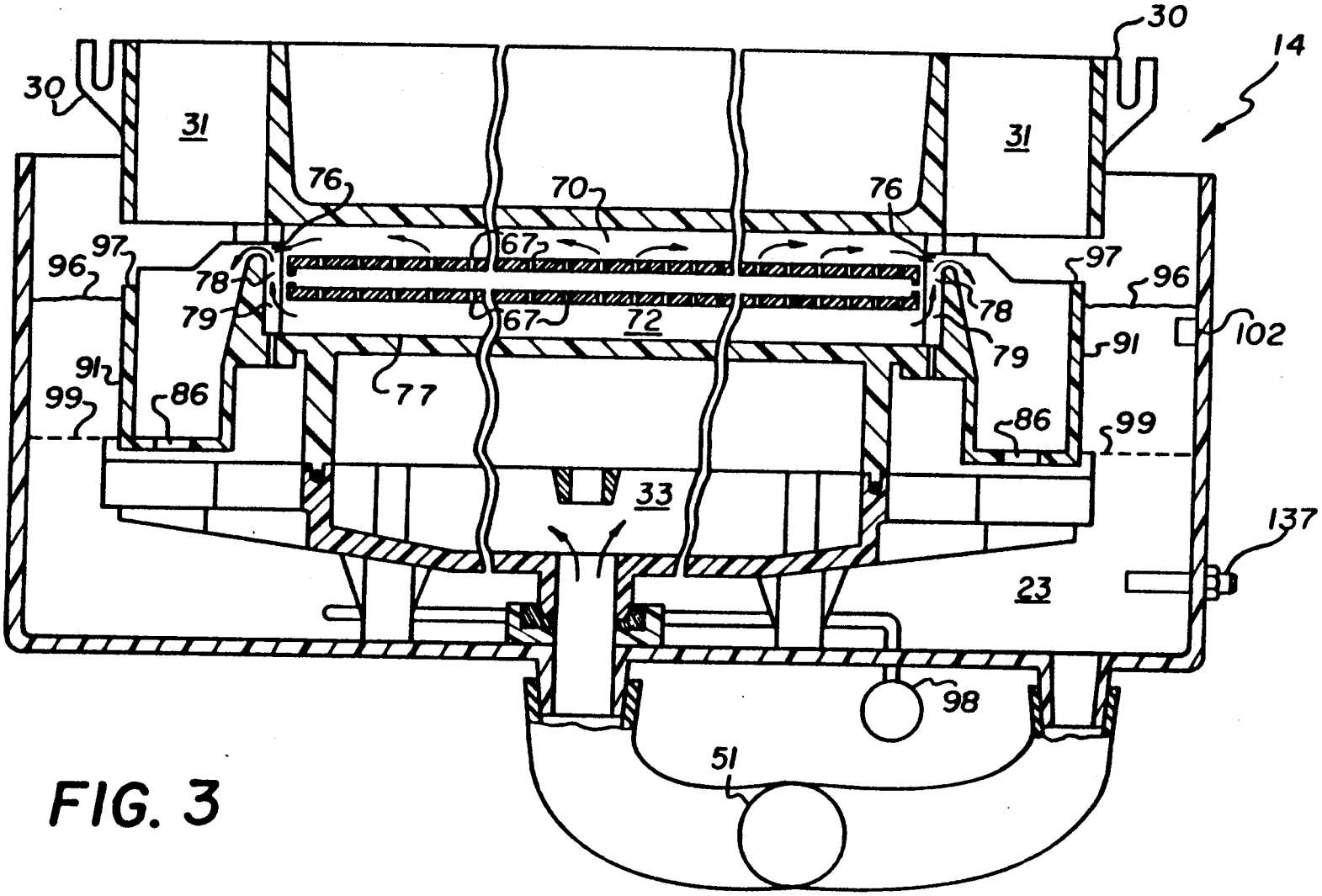
FIG. 3 is a cross-sectional view of the processing unit of FIG. 2 taken along line 3—3.
Figure 4:
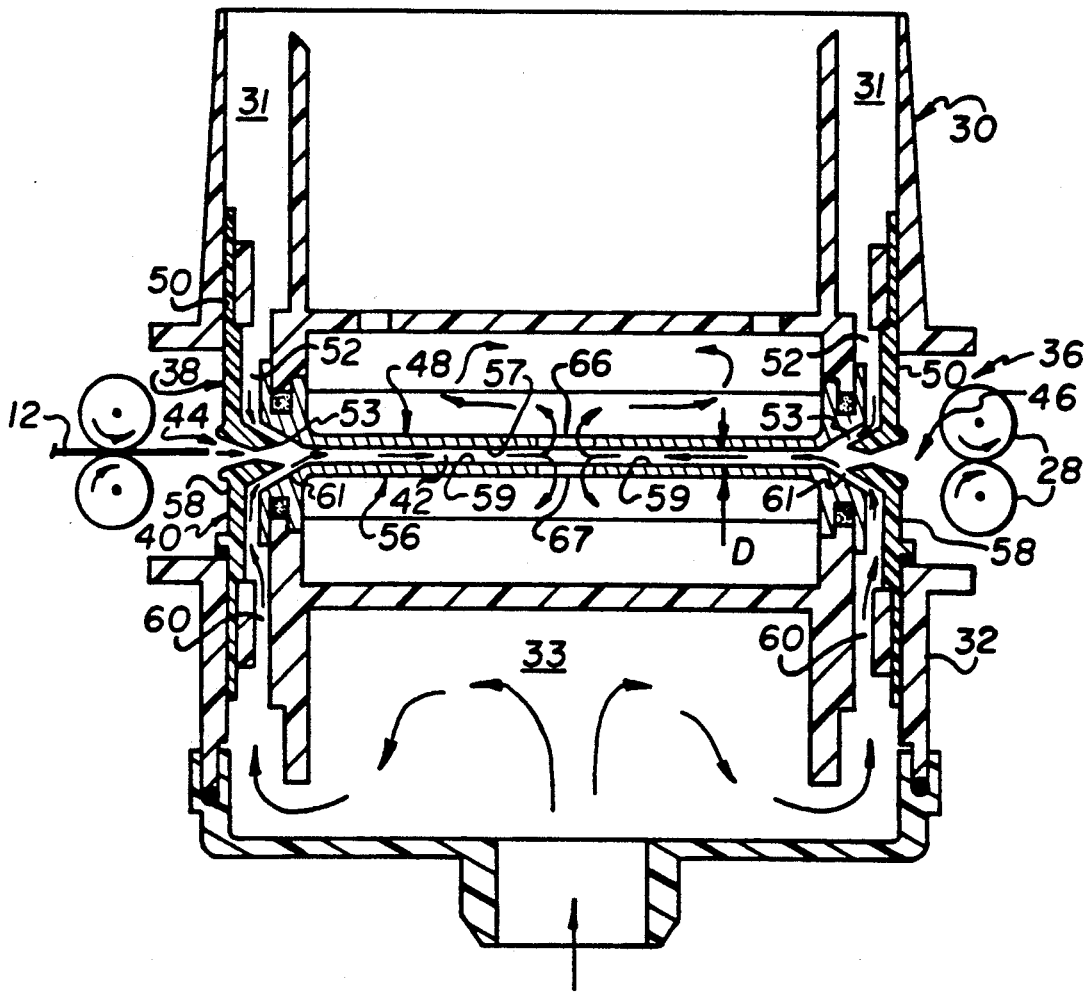
FIG. 4 is a cross-sectional view of processing unit of FIG. 2 as taken along line 4—4.
Figure 5:
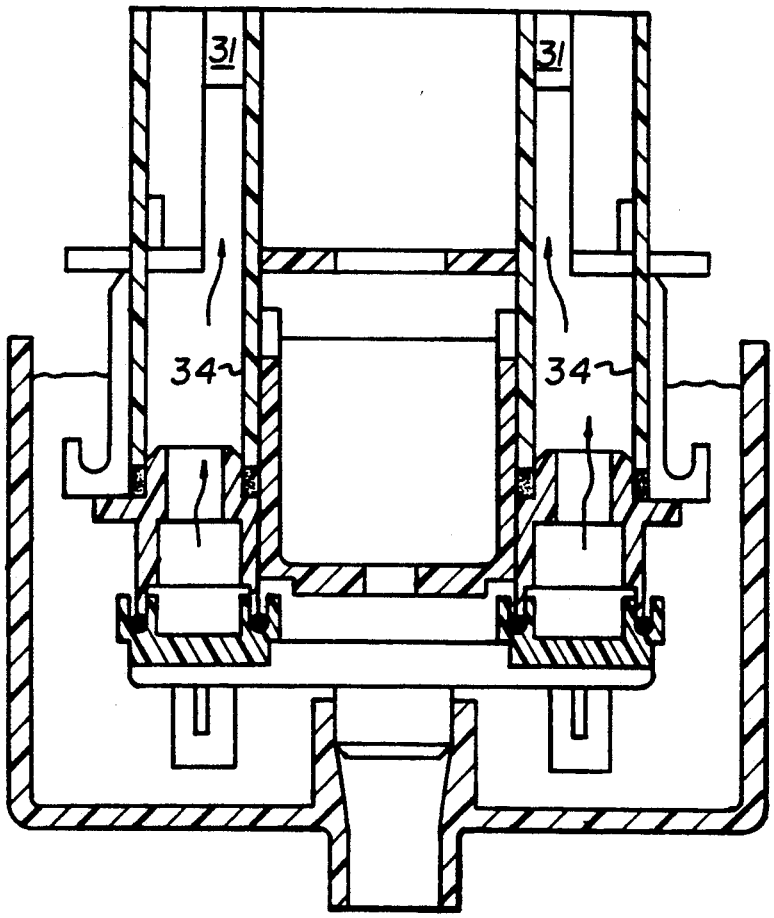
FIG. 5 is a cross-sectional view of the processing unit of FIG. 2 as taken along line 5—5 illustrating how the processing fluid passes from the lower tank to the upper tank.

FIG. 1 of the drawings illustrates a photographic processing apparatus made in accordance with the present invention, generally designated 10, that is useful for processing a strip or sheet of photosensitive material 12 (film, paper or other material). The photographic processing apparatus 10 includes a plurality of photographic processing units, three of which are shown at 14, 16 and 18. A processing fluid 22 is supplied to each unit. The processing fluid 22 is generally in a liquid form and includes such photographic processing liquids as developer, fixer, bleach, rinsing processing fluid, water, or any other processing fluids for use in the processing of photosensitive material. Any number of photographic processing units can be included in the photographic process apparatus 10 depending upon the number of processing fluids required for processing a specific photosensitive material. The processor may of course include other elements typically found in processors. For example, a dryer 20 may be provided for drying of the photosensitive material. Additionally a processing unit made in accordance with the present invention may be combined with other conventional processing units as desired.

A plurality of sump tanks 23,25,27 for holding a processing fluid are provided for units 14,16,18, respectively. The photosensitive material 12 is conveyed through the apparatus by a plurality of nip rollers 28 associated with the photographic processing units 14,16,18. The rollers 28 can be driven by any conventional drive means (not shown).

The photographic processing units 16,18 are the same or similar in construction to the photographic processing unit 14. Therefore only processing unit 14 will be discussed in detail it being understood that the other processing units are similarly constructed. Referring to FIGS. 2-6 processing unit 14 comprises an upper tank 30 and a lower tank 32 having processing fluid retention chambers 31,33, respectively, for holding processing fluid 22. Four connecting tubes 34 (as best seen by reference to FIG. 5) connect the retention chambers 31,33 of tanks 30 and 32 so as to allow processing fluid 22 to flow freely between the upper tank 30 and lower tank 32. The processing unit 14 further includes a processing section 36 located between the upper tank 30 and lower tank 32. The processing section comprises an upper nozzle assembly 38 associated with the upper tank 30 and a lower nozzle assembly 40 associated with lower tank 32. The upper and lower nozzle assemblies 38,40 define a narrow fluid processing chamber 42 through which the photosensitive material 12 travels during processing. The chamber 42 has an entrance 44 through which the photosensitive material enters the chamber 42 and an exit 46 through which the photosensitive material leaves the chamber 42. The upper nozzle assembly includes an inner nozzle 48 and a pair of outer nozzles 50 secured to upper tank 30. The inner and outer nozzles 48,50 define a pair of passage 52 which are in fluid communication with the processing fluid retention chamber 31 of the upper tank 32 and a pair of discharge openings/outlets 53 which extends along substantially the entire length of the tank 30 for dispensing of the processing fluid 22 into chamber 42. The outlets 53 allows processing fluid 22 to enter chamber 42 and create a first processing fluid layer on one side of the photosensitive material. The inner nozzle 48 comprises a substantially flat section 57 which forms the top of chamber 42.

The lower nozzle assembly 40 includes an inner nozzle 56 and a pair of outer nozzles 58 secured to lower tank 32. The inner and outer nozzles 56,58 define a pair of passage 60 which are in fluid communication with the retention chamber 33 of the lower tank 32 and a pair of discharge openings/outlets 61 for dispensing of the processing fluid into chamber 42 so as to create a second fluid layer 62 on the opposite side of the photosensitive material 12. The inner nozzle 56 comprises a substantially flat section 59 which forms the bottom of chamber 42. The top and bottom sections 57,59 are spaced apart a distance D such that the substantially narrow processing chamber 42 allows the photosensitive material 12 to easily pass therebetween and form a fluid processing layer on each side of the photosensitive material. In the particular embodiment illustrated the distance D is about 0.125 inches (0.3175 cms) and is designed to receive a photosensitive film has a thickness of about 0.007 inches (0.0175 cms).

Figure 6:
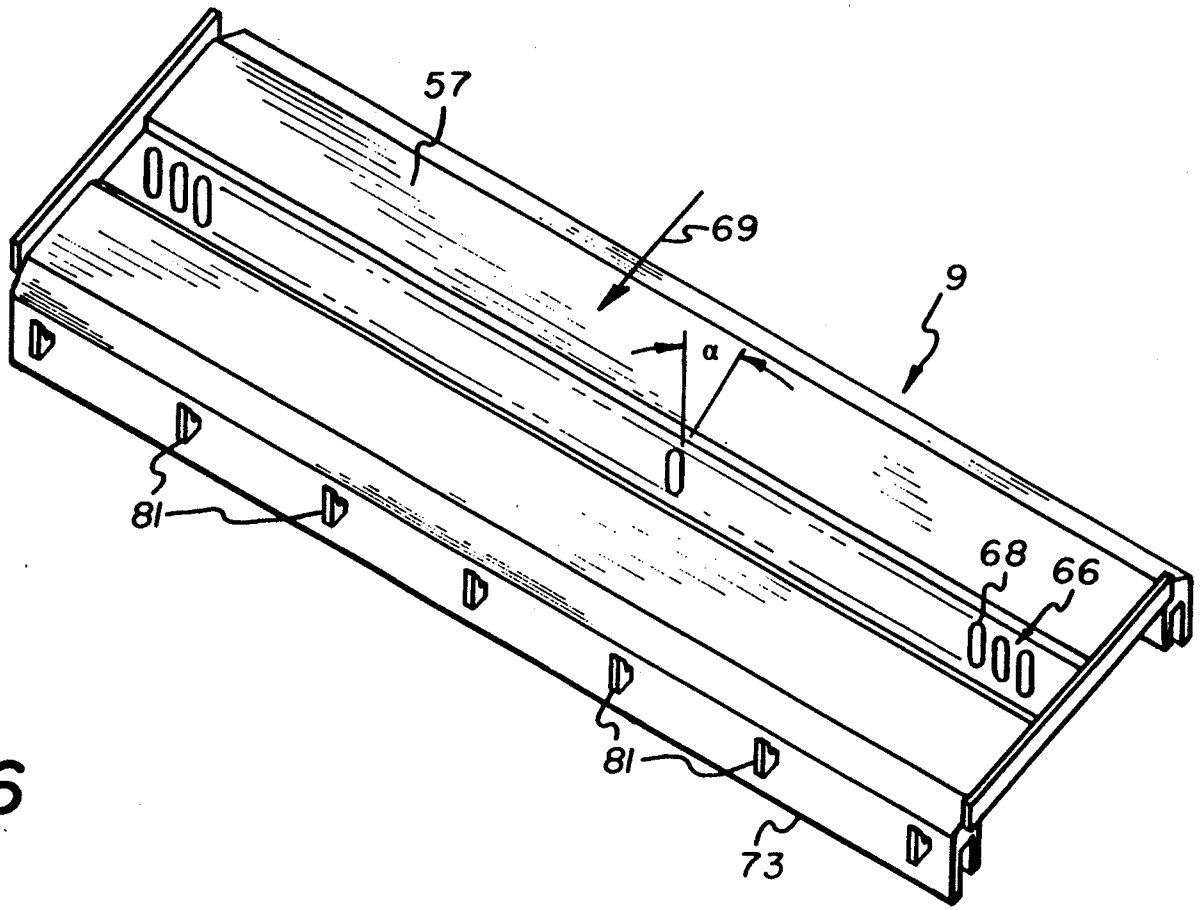
FIG. 6 is a perspective view of one of the inner nozzles of the processing unit illustrating the drain through which processing fluid returns to the sump tank for that particular processing unit.

Processing fluid is exhausted from chamber 42 by a pair of drains 66,67 provided in inner nozzles 48,56. FIG. 6 illustrates only one of the inner nozzles 48,56, it being understood that the other nozzle is substantially identical. Preferably as illustrated, the drains 66,67 are located substantially midway between the entrance 44 and exit 46 (see FIG. 4). The drains 66,67 each comprise a plurality of openings 68 provided in the substantially flat surfaces of inner nozzles 48,56. In the particular embodiment illustrated drains 66,67 each comprise a plurality of aligned slots 68 disposed at an angle $\alpha$ with respect to the direction of fluid flow (as indicated by arrow 69 in FIG. 6) across the inner nozzles. However, the drains 66,67 may comprise any number of openings having any desired configuration. Conduits or passageways 70,72 are formed between the inner nozzles 48,56 and tanks 30, 32 respectively for exhausting the fluid 22 from chamber 42. The conduits 70,72 terminate in outlets 76,78 for emptying the fluid to the sump tank 23. The conduits 70,72 are preferably configured such that the outlets 76,78 are positioned at substantially the same level so that equal back pressure is experience at the drains 66,67. This is described in greater detail in a copending commonly assigned patent application which was filed concurrently with this application entitled "Apparatus For Processing Photosensitive Material" of David G. Sherburne. In the particular embodiment illustrated this is achieved by providing a substantially straight conduit 70 having outlet 76 at first predetermined level or height and providing conduit 72 with a substantially straight horizontal section 77 and a vertical section 79 locating outlet 78 at substantially the same level or height as outlet 76. It is of course understood that the particular configuration of conduits may take a variety of other shapes so long as the outlets remains at substantially the same level.

A pair of weirs 91 are provided adjacent the outlets 76,78 for receiving the processing fluid. Each of the weirs 91 includes a wall having an upper edge 97 which is adjacent the outlets 76,78 and an opening 86 in the bottom for allowing fluid to return to the sump tank 23. In the particular embodiment illustrated the weirs 91 each have a substantially rectangular configuration and is sized such that the opening 86 is substantially always below the top of the fluid in sump tank 23. The size of opening 86 is selected such that the fluid 22 in the weir 91 during operation of the processing unit will be just below the upper edge 97 so as to minimize the formation of bubbles is in the processing fluid and thereby reduce its effectiveness.

A pump 51 is used to draw processing fluid from the sump tank 23 into the lower input 89 of the lower tank 32. The pump 51 causes the fluid 22 to go into the lower chamber 33, which in turn causes the processing fluid 22 to go into vertical tubes 34 so that processing fluid 22 will fill the upper tank 30. This will cause fluid 22 to fill both the upper and lower tanks 30,32 such that substantially equal fluid pressure is applied to the outlets 76,78 at the entrance 44 and exit 46 of the chamber 42. The level of the fluid 22 in sump tank 23 prior to operation of the pumps 51 is generally at the level indicated by line 96. However when the processor is initially started, the pump 51 is turned on and the retention chambers 31,33 of tanks 30,32 are filled with processing fluid from sump tank 23 causing the level of the processing fluid 22 in the sump tank 23 to be substantially lowered to the level indicated by dash line 99. The processor 10 is provided with an appropriate microprocessor control unit 138 for monitoring the apparatus 10 and controlling the various operations of the apparatus as is customarily done in the art. In the particular embodiment illustrated a liquid level senor 102 is provided for monitoring the level of fluid 22 in sump tank 23 and sensor 104 (see FIG. 1) is provided for monitoring the amount of photosensitive material 12 that has been processed through the processor 10. Sensors 102 and 104 may be of any type as is well known and used in the art. When the microprocessor control unit 138 senses that the pump 51 has been turned on and the level in the sump tank 23 has reached a predetermined lower level, for example the level indicated by indicated by dash line 99, a quantity of replenishment solution will be added to the processing fluid 22 in sump tank 23 to raise the processing fluid 22 to the desired level. The addition of this replenishment solution adds significantly to the amount of chemistry available for processing of photosensitive material 12 through the processing unit 14. As is typically done in the prior art, the microprocessor control unit 138 is programmed such that it will automatically provide additional replenishment solution to the processing fluid 22 in sump tank 23 in accordance to the amount of photosensitive material that has been processed through the processor. However, during initial start up of the processor, the addition of the large amount of replenishment solution in the present invention delays the need for adding additional replenishment solution required to increase the amount of available chemistry in the processing fluid 22. Therefore the microprocessor control unit 138 is programmed to delay the addition of replenishment solution until a certain amount of photo sensitive material has been processed through the processor 10. Thereafter the microprocessor control unit 138 will return to it normal programmed mode of adding replenishment solution in accordance with the amount of photosensitive material processed. The microprocessor control unit 138 can also be used to delay the amount replenishment solution to be delivered by tracking the amount of photosensitive material that is processed and the amount of additional replenishment solution that is added to the sump tank 23. For example, if the processing fluid 22 in sump tank 23 drops below the level of the level sensor 102 and the pump 51 turns on to deliver 50 ml of replenishment solution to bring the processing fluid 22 up to the level sensor 102 and photosensitive material 12 is processed which requires 100 ml of replenishment solution, then the microprocessor control unit 138 will activate pump 51 so as to allow only 50 ml of replenishment solution to be added, thereby adding only the quantity of replenishment fluid necessary for processing of the photosensitive material.

Figure 7A:
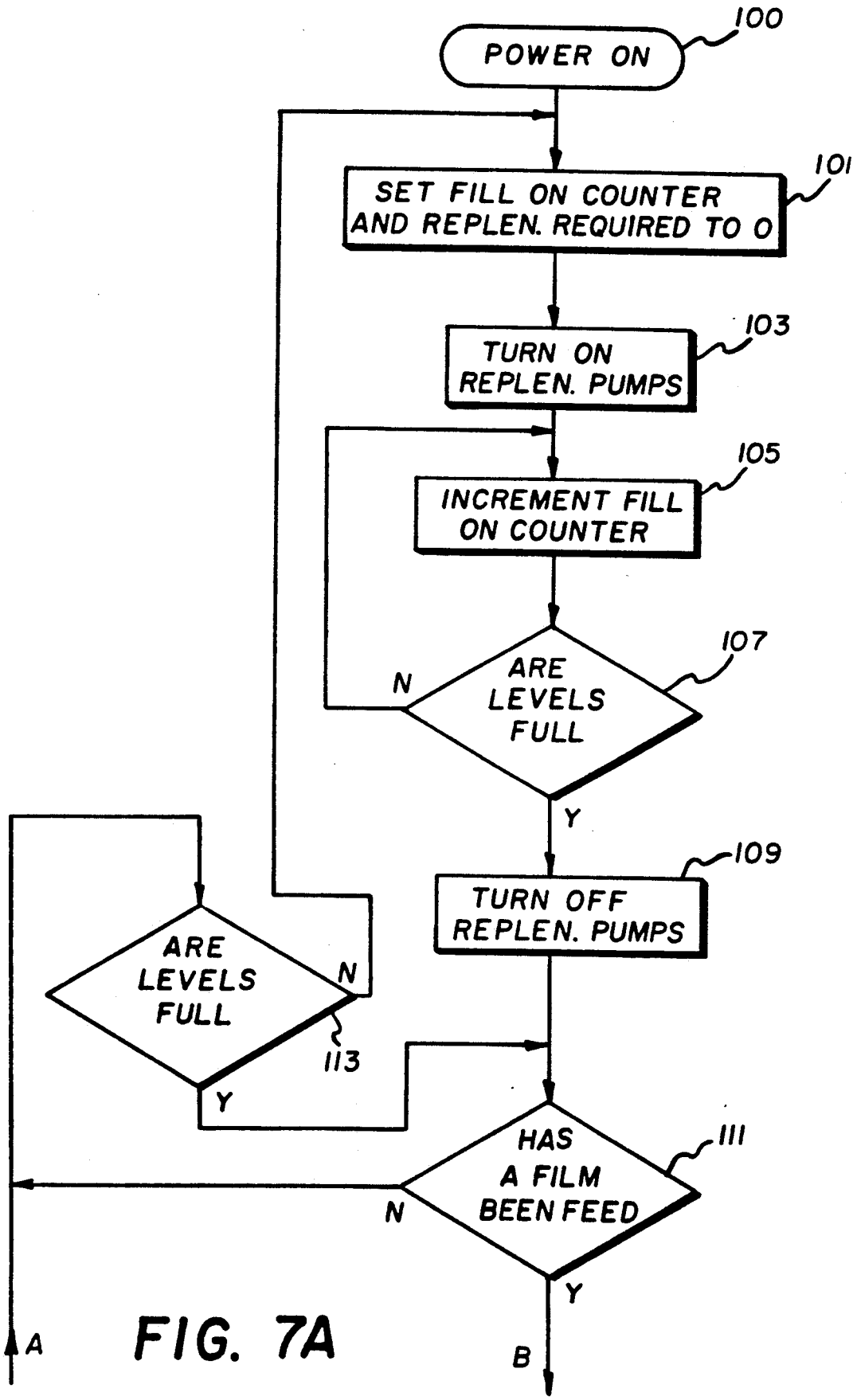
FIGS. 7A & 7B illustrate a flow diagram of the operation of the replenishment cycle of one of the processing units of the processor of the present invention.
Figure 7B:
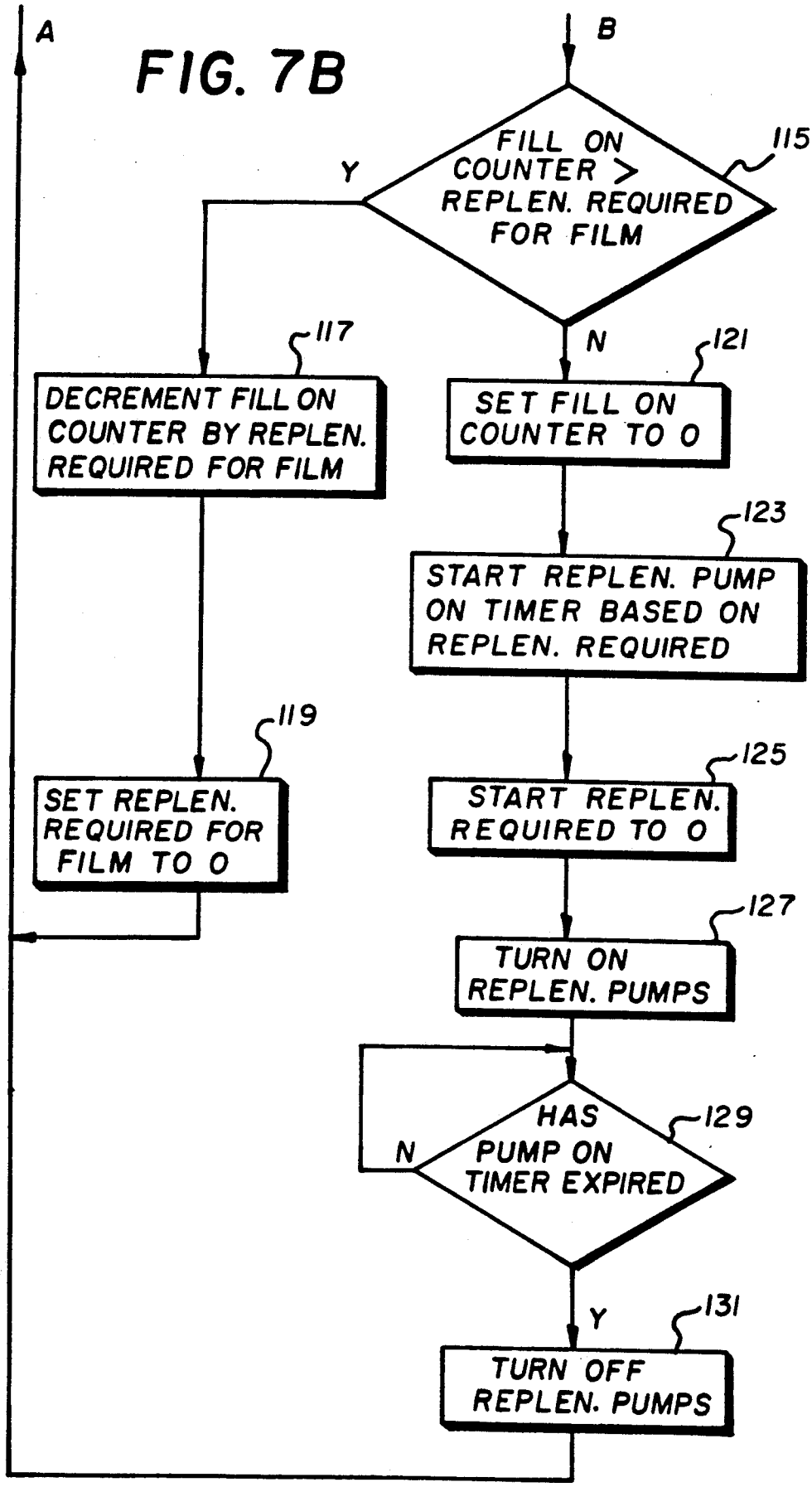

Referring to FIGS. 7A & 7B, there is illustrated a flow chart of the replenishment cycle of an apparatus made in accordance with the present invention. The apparatus is first powered up at 100. Thereafter the CPU 138 sets the replenishment fill counter to zero at 101. The replenishment pump is then turned on for a predetermined period of time at 103 and is allowed to operate so as to provide a predetermined incremental amount of replenishment fluid at 105. The CPU at 107 then determines if the processing fluid in the sump tank is at the appropriate level. If the processing fluid is not at the appropriate level then an additional incremental amount of replenishment fluid is added at 105. When the processing fluid in the sump tank has reached the desired level then the pump is turned off at 109. A second decision point is then reached at 111. If no film has been fed through the processing unit the CPU goes to decision point 113. If the fluid level in the sump tank is at the desired level then the CPU continues to loop through decision points 111,113. However, if the fluid level is low then the replenishment cycle will go to 101 where it will go through the initial fill cycle as previously described. If film has been passed through the processing unit then a third decisions point is reached at 115. At this point the CPU determines if the amount of chemistry provided in the replenishment fluid initially supplied to fill the sump tank is greater than the amount of chemistry needed to process the film which has been processed. If the amount of available chemistry initially supplied has not been depleted, then the next step is at 117 where the CPU reduces the amount of film necessary to be processed to use the chemistry initially supplied. Next at 119 the replenishment counter is set to zero. Then a decision point at 113 is reached. If the processing fluid in the sump tank is at the appropriate level then the replenishment cycle goes to 111 which monitors if any additional film has been processed. If at 113 it is determined that the level in the sump tank is too low then processor goes through the sump tank fill up procedure at 101. Returning to decision point 115, once a sufficient amount of film has been processed which utilizes all of chemistry initially supplied at power up and thus requiring additional replenishment fluid to be supplied, the fill counter is set to zero at 121. Next the replenishment timer is set based upon the amount of replenishment fluid required to be supplied at 123. The replenishment counter is set to zero at 125. At 127 the pump is turned on. A decision point is then reached at 129 wherein it is determined if the pump has been on for the appropriate amount of time previously calculated. Once the time period for activating the pump has expired, the pump is turned off at 131. Then the next decision point at 113 is again reached as previously discussed. The cycle continues as appropriate.

As is well known in the art, various other modifications may be made to the processing unit as is customary. For example, in the particular embodiment illustrated, a heat exchanger 98 is provided for cooling of the processing fluid. Additionally, an optional heater 137 may also be provided for heating of the processing fluid 22 when necessary. While the drawings illustrate the pump 51 as being located outside of the sump tank 23, the pump 51 could equally be located within the sump tank 23 if desired. Additionally, appropriate connections may be provided for connecting of the sump tank 23 to the pump 51 and to the lower tank 32 by suitable means.

While the present invention has been described for use in a fluid suspension type processor having an upper and lower tank, the present invention may be used in various other type processors. For example, but not by way of limitation, only one tank need be provided for holding of a processing fluid. Additionally, the present invention may be used in any processor wherein a processing fluid is taken from a sump tank and delivered to a processing chamber for processing of a photosensitive material which is remote or otherwise not immersed in the sump tank.

The present invention includes an apparatus for processing photosensitive material having means for efficiently utilizing the amount of replenishment solution that is supplied to the sump tank in accordance with the amount of photosensitive material that is processed both during initial start up and during normal operation.

The invention has been described in detail with particular reference to a preferred embodiment thereof, but it will be understood that variations and modifications can be made without departing from the scope of the present invention. The present invention being limited by the following claims.

I claim:

1. A method of replenishing a solution in a film processor having an upper tank and a lower tank which form a processing chamber there between through which a photosensitive material can be advanced, said upper tank being substantially empty before powering up of the film processor, and a sump tank for supplying a processing fluid to the upper and lower tanks, the method comprising the steps of:

adding a sufficient amount of replenishment solution to the sump tank upon powering up of the film processor and filling of the upper and lower tanks with processor fluid from the sump tank so that the level of the processing fluid in the sump tank is raised to a predetermined level delaying the addition of further replenishment solution until a predetermined amount of photosensitive material has been processed through the film processor; and thereafter replenishing the processing fluid in the sump tank in accordance with the amount of film that has been processed by the film processor.

2. A method of replenishing a solution in a film processor having an upper tank and a lower tank which form a processing chamber there between through which a photosensitive material can be advanced, said upper tank being substantially empty before powering up of the film processor, and a sump tank for supplying a processing fluid to the upper and lower tanks, the method comprising the steps of:

monitoring the level of the processing fluid within the sump tank and adding a sufficient amount of replenishment solution to the sump tank so as to raise the level of the processing fluid in the sump tank to a predetermined level;

delaying the addition of further replenishment solution until a predetermined amount of photosensitive material has been processed through the film processor; and thereafter replenishing the processing fluid in the sump tank in accordance with the amount of film that has been processed by the film processor.

3. A method of replenishing a solution in a film processor having a sump tank for holding a processing fluid, a processing chamber for processing of a photosensitive material, said processing chamber being substantially empty before powering up of the film processor, and means for removing processing fluid from the sump tank and delivering it to the processing chamber for processing of a photosensitive material, the method comprising the steps of:

adding a sufficient amount of replenishment solution to the sump tank upon powering up of the film processor and supplying the processing chamber with fluid from the sump tank so that the level of the processing fluid in the sump tank is raised to a predetermined level; and delaying the addition of further replenishment solution until a predetermined amount of photosensitive material has been processed through the film processor; and thereafter replenishing the processing fluid in the sump tank in accordance with the amount of film that has been processed by the film processor.

4. A method of replenishing a solution in a film processor having a sump tank for holding a processing fluid, said processing chamber being substantially empty before powering up of the film processor, a processing chamber for processing of a photosensitive material, and means for removing processing fluid from the sump tank and delivering it to the processing chamber for processing of a photosensitive material, the method comprising the steps of:

monitoring the level of the processing fluid within the sump tank and adding a sufficient amount of replenishment solution to the sump tank so as to raise the level of the processing fluid in the sump tank to a predetermined level;

delaying the addition of further replenishment solution until a predetermined amount of photosensitive material has been processed through the film processor; and thereafter replenishing the processing fluid in the sump tank in accordance with the amount of film that has been processed by the film processor.

* * * * *